US010881176B1

(12) United States Patent
Holbrook et al.

(10) Patent No.: US 10,881,176 B1
(45) Date of Patent: Jan. 5, 2021

(54) UMBRELLA

(71) Applicants: Richard Holbrook, Pasadena, CA (US); Darren Mark, Pasadena, CA (US)

(72) Inventors: Richard Holbrook, Pasadena, CA (US); Darren Mark, Pasadena, CA (US)

( * ) Notice: Subject to any disclaimer, the term of this patent is extended or adjusted under 35 U.S.C. 154(b) by 0 days.

(21) Appl. No.: 16/800,508

(22) Filed: Feb. 25, 2020

(51) Int. Cl.
*A45B 25/14* (2006.01)
*A45B 25/02* (2006.01)
*A45B 11/00* (2006.01)

(52) U.S. Cl.
CPC ..... *A45B 25/14* (2013.01); *A45B 11/00* (2013.01); *A45B 25/02* (2013.01); *A45B 2011/005* (2013.01); *A45B 2200/10* (2013.01)

(58) Field of Classification Search
CPC ..... A45B 25/14
See application file for complete search history.

(56) References Cited

U.S. PATENT DOCUMENTS 2,568,362 A * 9/1951 Primavera ..... A45B 25/14 135/20.3
2,782,795 A * 2/1957 Small ..... A45B 25/14 135/20.3
2,937,653 A * 5/1960 Danciart ..... A45B 25/08 135/37
4,567,907 A 2/1986 Dubinsky
6,173,721 B1 * 1/2001 Mery ..... A45B 25/14 135/16
6,325,084 B1 12/2001 Cohen
6,386,214 B1 * 5/2002 Clarke ..... A45B 25/02 135/16
D475,524 S 6/2003 Clarke
D503,272 S 3/2005 Machin
D513,118 S 12/2005 Browne
D526,476 S 8/2006 Browne
7,178,535 B2 2/2007 Eder
7,318,444 B2 1/2008 Clarke
D609,453 S 2/2010 Liu
7,900,643 B2 3/2011 Ma
8,061,375 B2 11/2011 Ma
(Continued)

FOREIGN PATENT DOCUMENTS

EP 1654952 5/2006
EP 2845509 3/2015
(Continued)

*Primary Examiner* — Noah Chandler Hawk
(74) *Attorney, Agent, or Firm* — Todd R. Miller

(57) ABSTRACT

A novel umbrella is disclosed with a simplified structure that creates a clean, elegant profile. The umbrella includes a support post, a top housing supported by the post, and a bottom housing supported by the post. Spokes are pivotally disposed about the top housing. Struts are pivotally disposed about the bottom housing, wherein each strut is pivotally connected to a respective spoke. A canopy is disposed about the plurality of spokes. A first and second set of rollers may be retained with the top housing. A third set of rollers may be retained within the bottom housing. A rope raises and lowers the canopy. A lever lock is disposed about the bottom housing to retain the rope when the umbrella is in an open position. The umbrella also has a rope storage slot within the support post for retaining any excess rope.

13 Claims, 12 Drawing Sheets

(56) References Cited

U.S. PATENT DOCUMENTS

| | | | | |
|---|---|---|---|---|
| 8,087,420 | B1 * | 1/2012 | Lukacsy | A45B 25/16 135/22 |
| 8,166,986 | B2 | 5/2012 | Ma | |
| 9,655,416 | B1 * | 5/2017 | Clarke | A45B 25/14 |
| D813,524 | S | 3/2018 | Ma | |
| 2002/0046761 | A1 * | 4/2002 | Liang | A45B 25/14 135/16 |
| 2002/0088483 | A1 * | 7/2002 | Clarke | A45B 23/00 135/15.1 |
| 2006/0102215 | A1 | 5/2006 | Eder | |
| 2007/0062565 | A1 | 3/2007 | Clarke | |

FOREIGN PATENT DOCUMENTS

| | | |
|---|---|---|
| EP | 2223624 | 7/2015 |
| EP | 2774503 | 4/2017 |

* cited by examiner

UMBRELLA

BACKGROUND

The present disclosure relates generally to a shade device and particularly to a novel umbrella with a simplified structure that creates a streamlined and elegant profile.

SUMMARY

One exemplary embodiment of the disclosed subject matter is an umbrella comprising a support post, a top housing supported by the post, and a bottom housing supported by the post. Spokes are pivotally disposed about the top housing. Struts are pivotally disposed about the bottom housing, wherein each strut is pivotally connected to a respective spoke. A canopy is disposed about the plurality of spokes.

A first set of rollers are retained with the top housing and aligned together along one side. A second set of rollers are retained with the top housing and aligned together along a side opposite the first set of rollers. The axes of the first and second sets of rollers are substantially parallel to one another. A third set of rollers are retained within the bottom housing and aligned together along a side of the bottom housing. The axis of the third set of rollers is substantially orthogonal to the axes of the first and second sets of rollers. A rope raises and lowers the canopy, wherein the rope preferably runs along the first set of rollers, along the third set of rollers, and then along the second set of rollers.

The umbrella may further comprise a roller retained within the bottom housing and disposed along a side of the bottom housing opposite the third set of rollers. When this roller is employed, the rope runs along the first set of rollers, along the third set of rollers, along the second set of rollers, and then to the roller within the bottom housing.

The umbrella may also include a lever lock disposed about the bottom housing, wherein the lever lock is adapted to retain the rope when the umbrella is in an open position.

The umbrella also preferably has a rope storage slot within the support post for retaining any excess rope. When the umbrella is in an open position, a portion of the rope is received within the rope storage slot, with the remainder of the rope being retained by the lever lock after the rope runs through the hole within the bottom housing, along the first set of rollers, along the third set of rollers, along the second set of rollers, and then to the roller within the bottom housing.

The top housing may comprise a top hub, a top plate disposed about the top hub, and a bottom cover disposed about the top hub opposite the top plate. The top hub has a first set of roller channels cut within the top hub. The top hub also has a second set of rollers channels cut within the top hub substantially opposite the first set of roller channels. The bottom housing may comprise a bottom hub, a top cap disposed about the bottom hub, and a bottom cap disposed about the bottom hub opposite the top cap. The bottom hub has a third set of roller channels cut within the bottom hub. The first set of rollers is retained within the first set of roller channels. The second set of rollers is retained within the second set of roller channels. The third set of rollers is retained within the third set of roller channels.

Another exemplary embodiment of the disclosed subject matter is an umbrella having a manual lift arrangement instead of the block and tackle pulley arrangement discussed above. With the manual lift arrangement, the umbrella comprises a support post having a hole, a top housing, and an opposing bottom housing. Each housing is supported by the post. The bottom housing preferably has a bottom hub, a top cap disposed about the bottom hub, and an opposing bottom cap disposed about the bottom hub opposite the top cap. The bottom cap has a lever lock receptacle. A plurality of spokes are pivotally disposed about the top housing. A canopy is disposed about the plurality of spokes. A plurality of struts are pivotally disposed about the bottom housing. A lever lock is retained by the lever lock receptacle, wherein the lever lock has a pin adapted to fit within the hole of the post for retaining the umbrella in an open position.

The top housing may include a top hub, a top plate disposed about the top hub, and an opposing bottom cover disposed about the top hub opposite the top plate. The top hub has spoke channels extending away therefrom, wherein the spoke channel is adapted to receive an end of a spoke. With this arrangement, one end of each strut is pivotally connected to the bottom hub, wherein the other end of each strut is pivotally connected to a respective spoke.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

FIG. 3A is a perspective view of the top hub, opposing bottom hub, and spoke arrangement of the umbrella seen in FIG. 3B;

DETAILED DESCRIPTION

Figure 1:
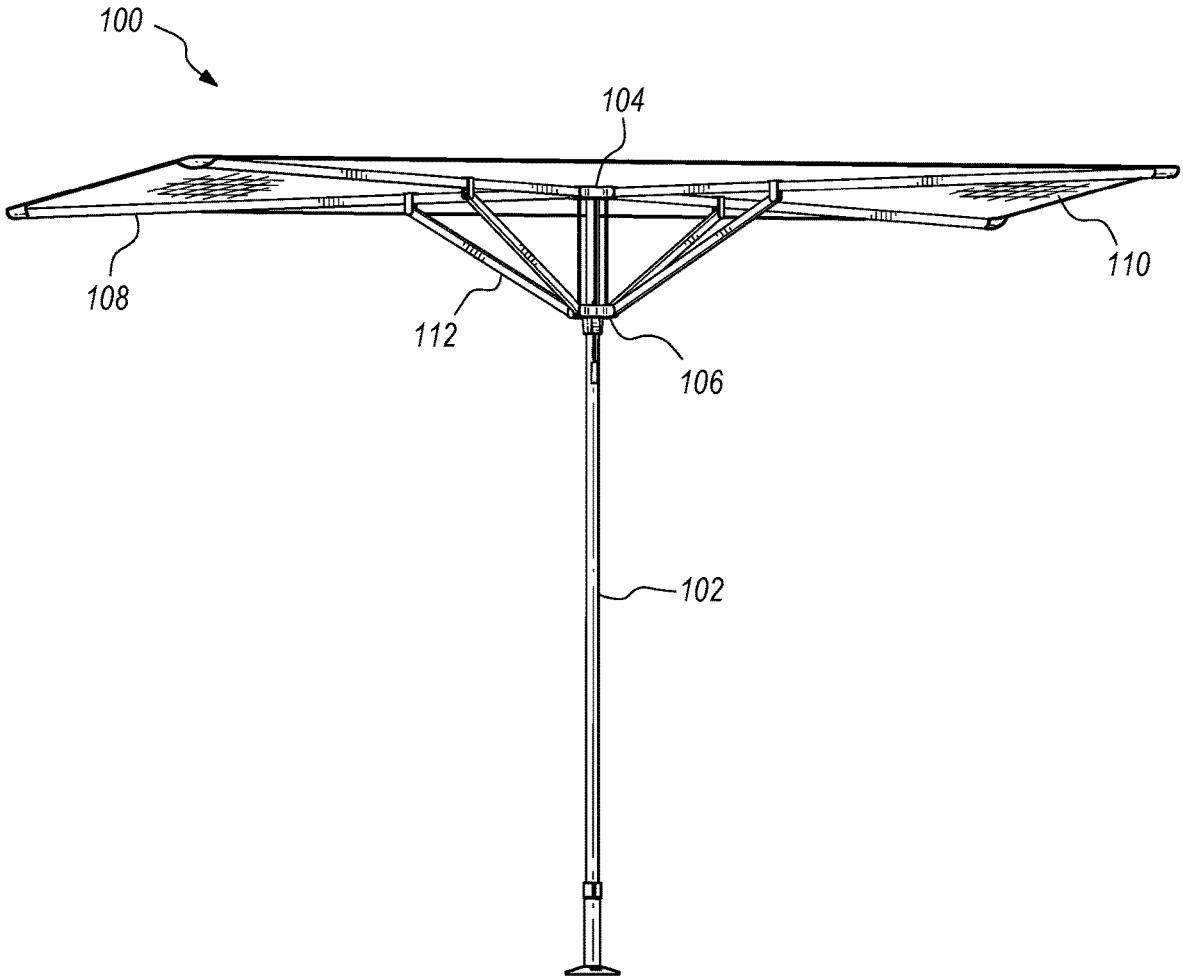
FIG. 1 is a perspective view of one embodiment of the umbrella disclosed herein.

Shade devices such as umbrellas are often necessary for relaxing at the pool or beach without concern of too much sun. A conventional umbrella often has a complex framework of tubes and connectors that make the umbrella look cluttered and mechanical. Such tubes and connectors are typically vulnerable to corrosion and require frequent cleaning. Moreover, the standard umbrella using a rope or line to raise and/or lower the canopy typically employs a cam cleat to retain the line. The excess line is then coiled and hung, resulting in a messy look.

Accordingly, a novel umbrella with a simplified structure that creates a clean, elegant profile is desired.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

FIGS. 1-6 illustrates a perspective view of one embodiment of the novel umbrella disclosed herein. As seen in these figures, umbrella 100 includes a support post 102, top and bottom housings 104, 106, spokes pivotally connected to the top housing 104, a canopy 110 disposed about the spokes 108, struts 112 pivotally connected to the bottom housing 106, and optional base 172.

Figure 2:
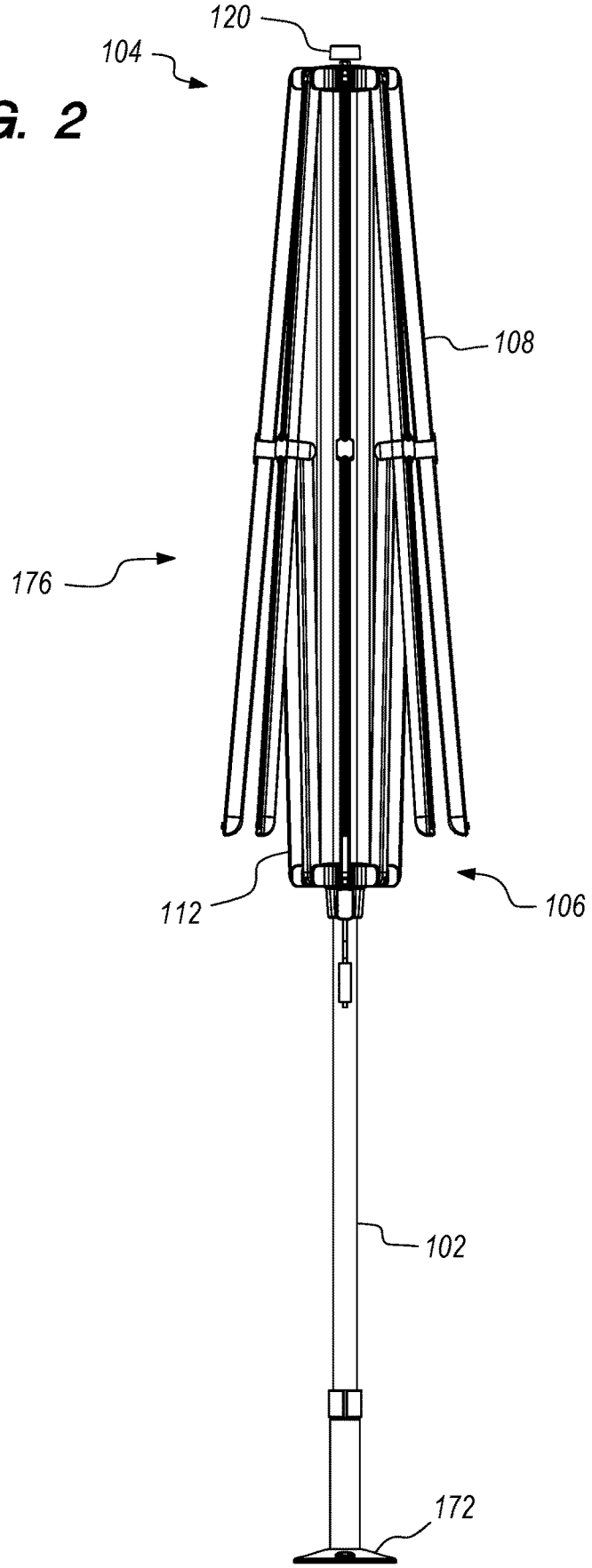
FIG. 2 is a side view of the umbrella seen in FIG. 1, with optional base, but without the canopy, showing the umbrella in the closed position.
Figure 3A:
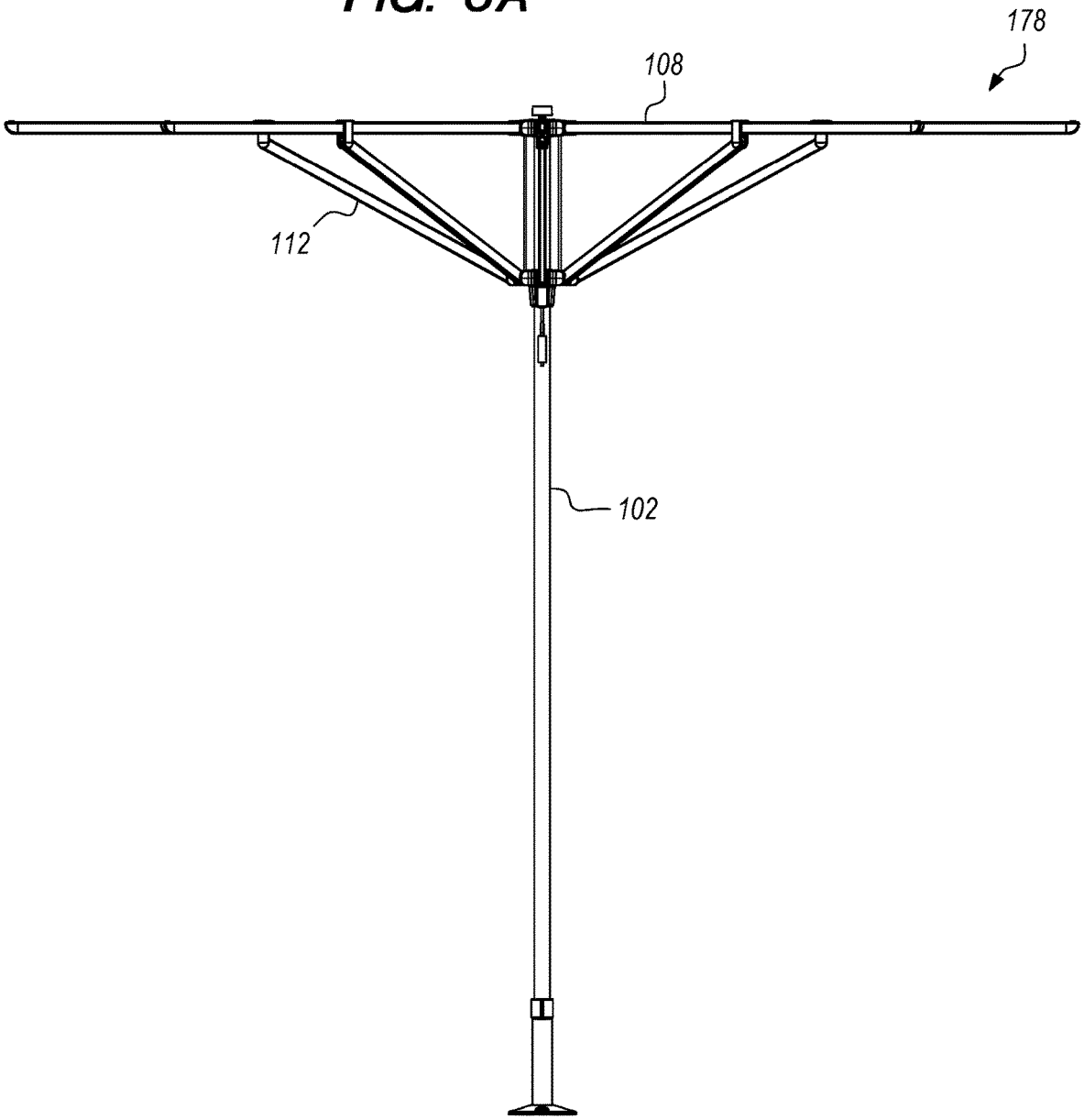
FIG. 3A is a side view of the umbrella seen in FIG. 2, showing the umbrella in the open position.
Figure 3B:
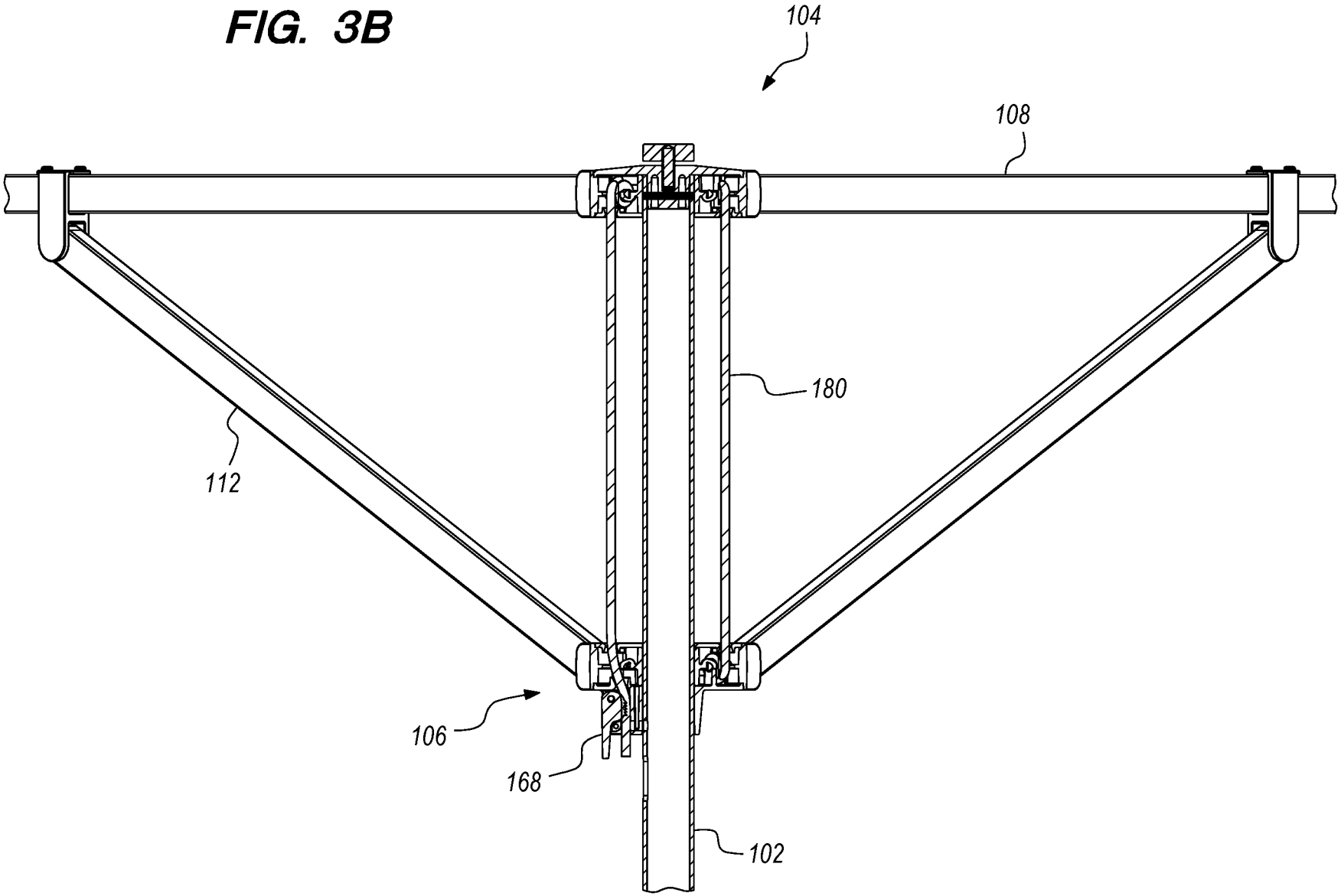
FIG. 3B is a cross-sectional view of part of the umbrella in FIG. 3A.
Figure 4:
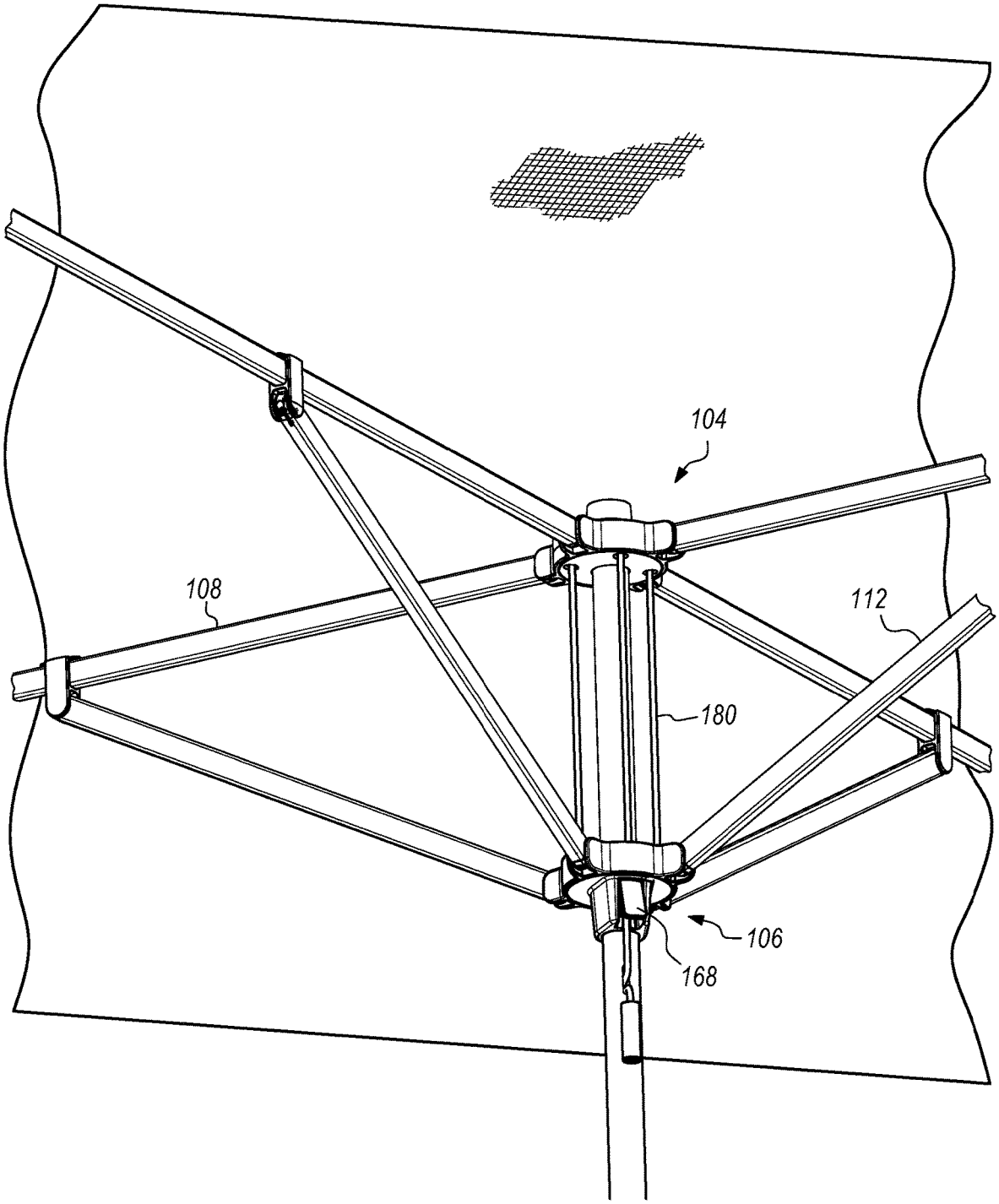
FIG. 4 is a perspective view of the top hub and spoke arrangement, as well as the opposing bottom hub and strut arrangement, of the umbrella seen in FIG. 1.

As seen in FIG. 1, the spokes 114 radially extend away from the top housing 104 when the umbrella 100 is in its fully opened position 172. Compared to FIG. 2, which shows the umbrella 100 in its closed position 176, spokes 108 have gone from being substantially parallel to the post 102 in the closed position 176 to substantially orthogonal to the post 102 in the open position 178. FIG. 2 also shows an optional base 172 disposed about the bottom end of post 102.

Figure 5:
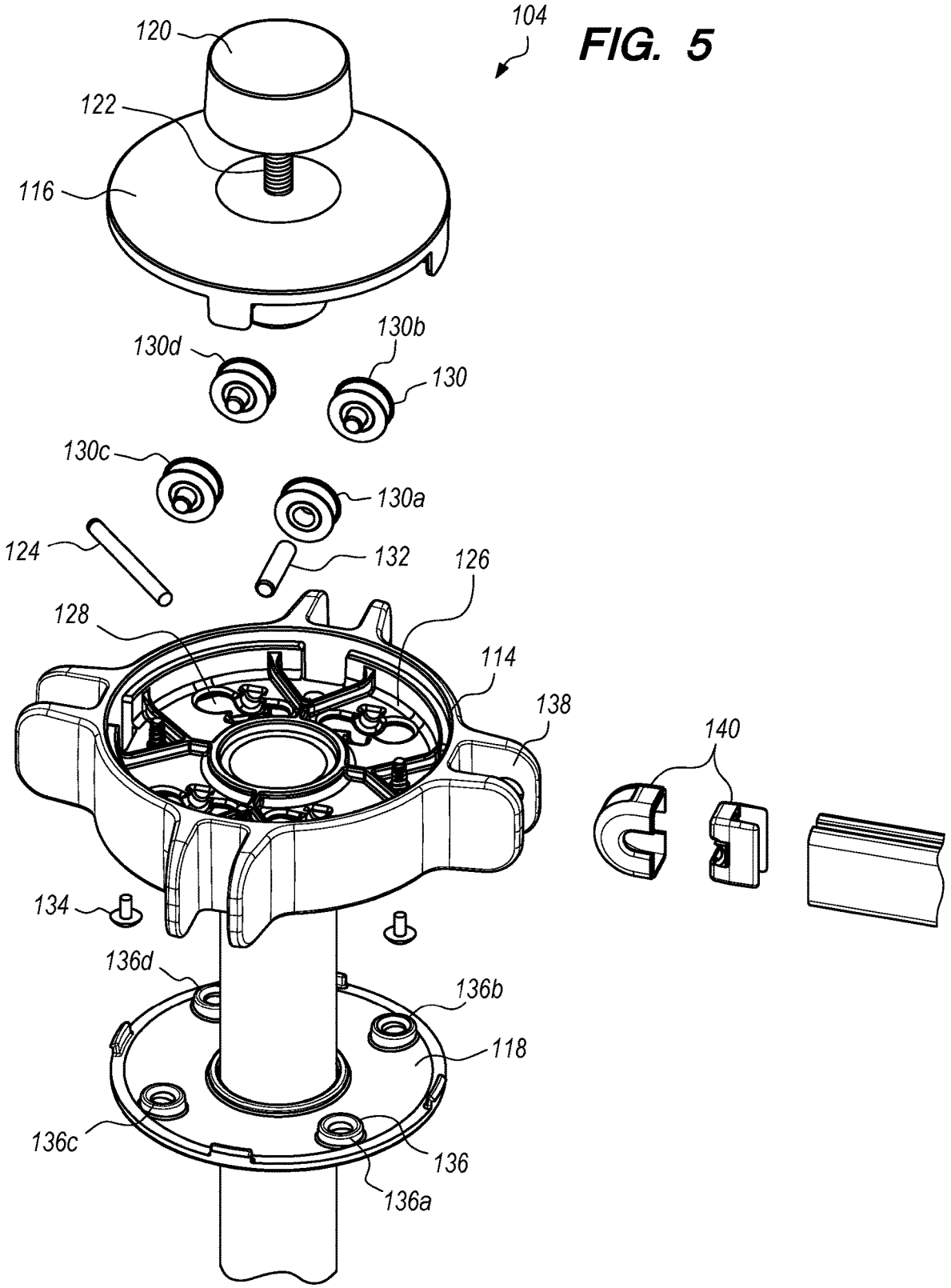
FIG. 5 is an exploded view of the top hub and spoke arrangement.

The details of the top housing 108 may be best seen with reference to FIG. 5. There, top housing 104 is illustrated with a top hub 114 preferably made of thermoplastic. Top hub 110 has a top plate 116 and an opposing bottom cover 118. A finial 120, preferably made of aluminum, retains the canopy 110. The finial 120 is attached to a threaded rod 122, preferably made of stainless steel. The rod 122 is coupled to a central location within the top plate 116, which is also preferably made of thermoplastic. The top plate 116 is coupled to the post 102 with a drive pin 124.

The top hub 114 has a cavity 126 and roller channels 128. Each roller channel 128 receives a roller 120 with its roller axle 132. The roller 120 is preferably made of thermoplastic, whereas the roller axle 132 is preferably made of stainless steel. Each roller 120 and axle 132 assembly snaps into its respective roller channel 128 as seen in FIG. 5.

In particular, a first set of rollers 130*a*, 130*c* are retained with the top housing 104 and aligned together along one side, as illustrated in FIG. 5. A second set of rollers 130*b*, 130*d* are retained with the top housing 104 and aligned together along a side opposite the first set of rollers 130*a*, 130*c*. The axes of the first (130*a*, 130*c*) and second (130*b*, 130*d*) sets of rollers are substantially parallel to one another.

Hardware 134 retains the top hub 114 to the top plate 116. The bottom cover 118 has a plurality of holes 136 for receiving a rope 180 or the like used to raise and lower the canopy 110. The bottom cover 118 is adapted to snap into the top hub 114 to conceal the roller 120 and axle 132 assemblies. As seen in FIG. 5, the top hub 114 also has a plurality of spoke channels 138 extending away from the top hub 114. Each spoke channel 138 is adapted to receive two-piece spoke ends 140, which screw into guides in the spokes 108. The spokes 108, struts 112, and post 102 are preferably extruded aluminum and may be in satin anodized or powder coated finishes.

Figure 6:
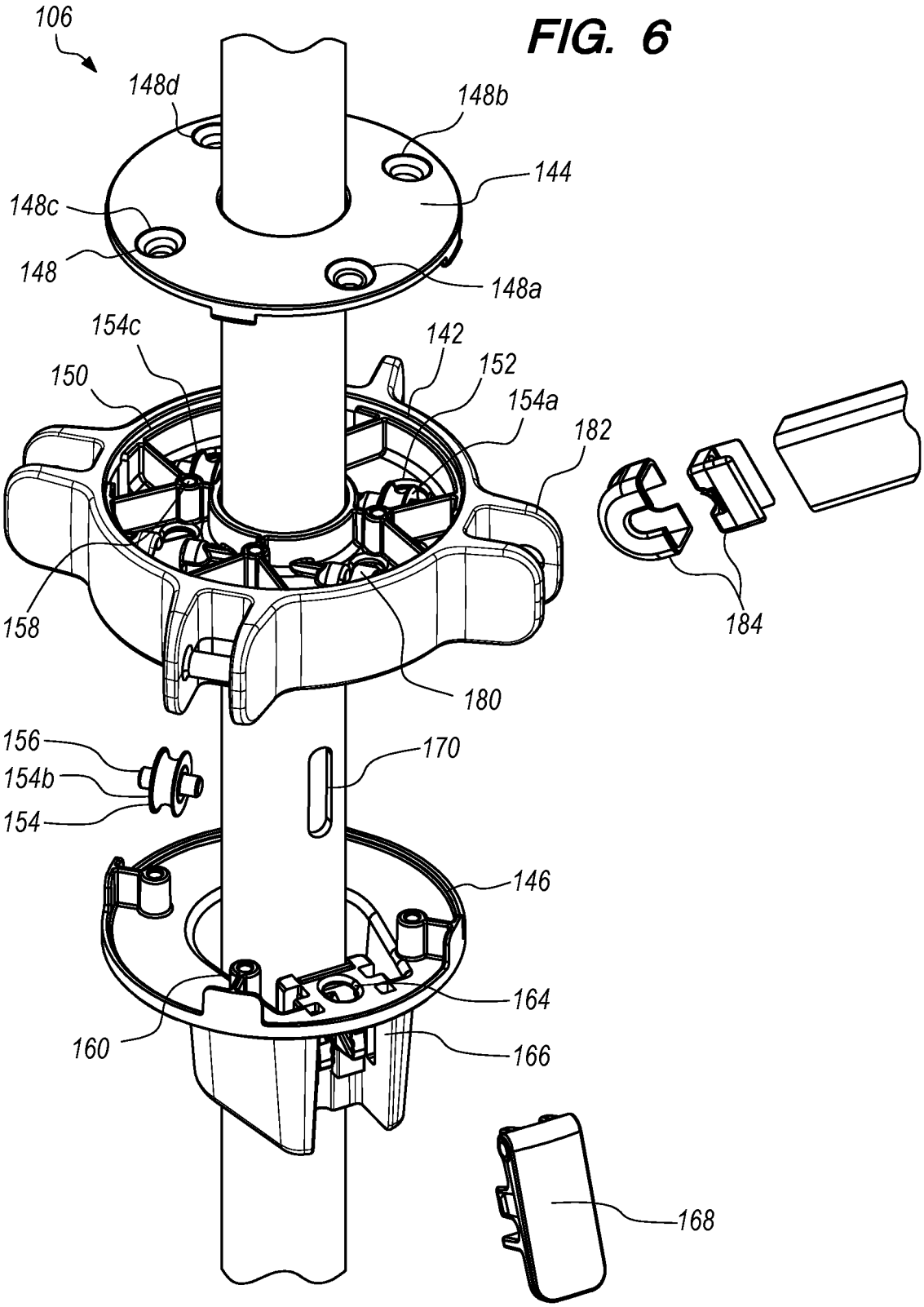
FIG. 6 is an exploded view of the bottom hub and strut arrangement.
Figure 7:
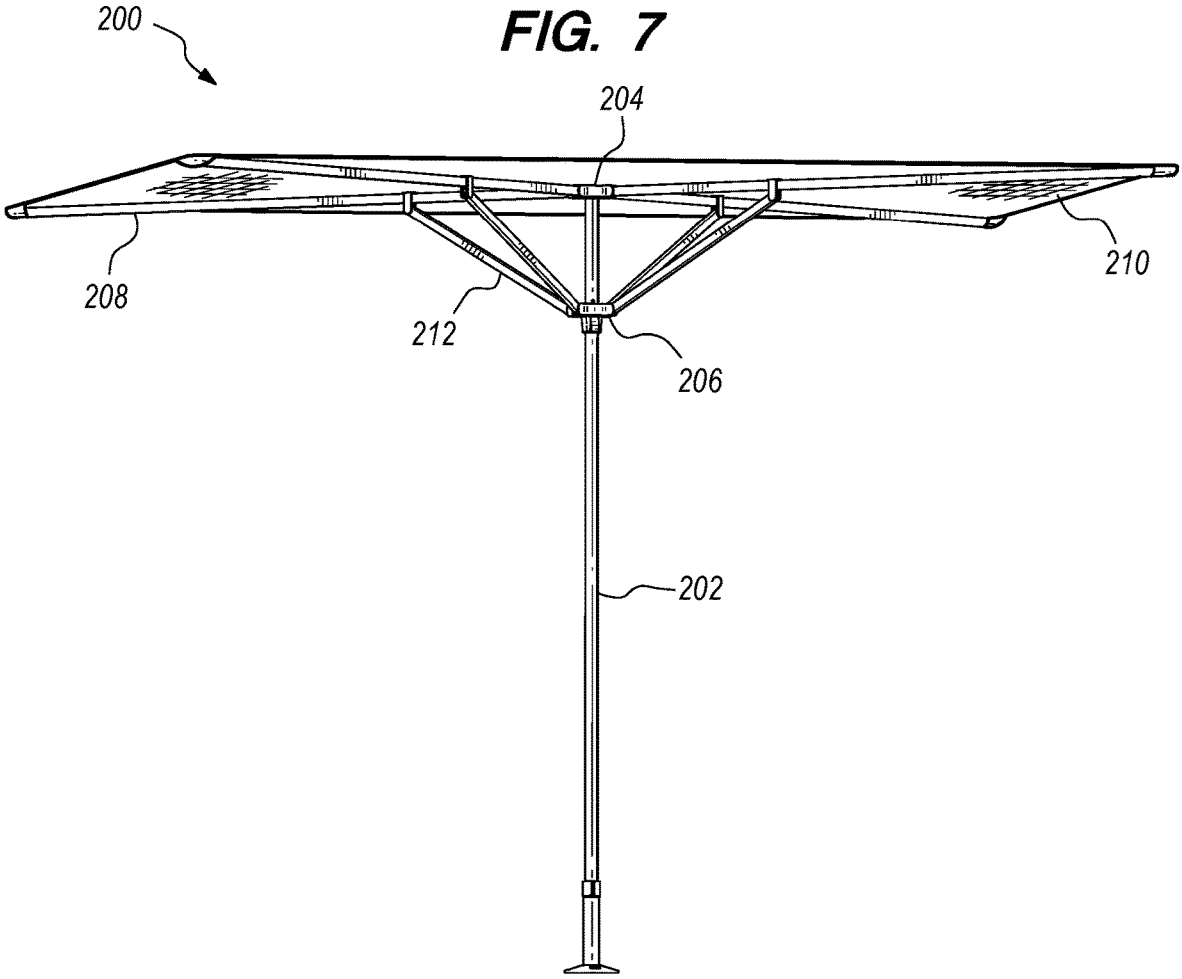
FIG. 7 is a perspective view of another embodiment of the umbrella disclosed herein.
Figure 8:
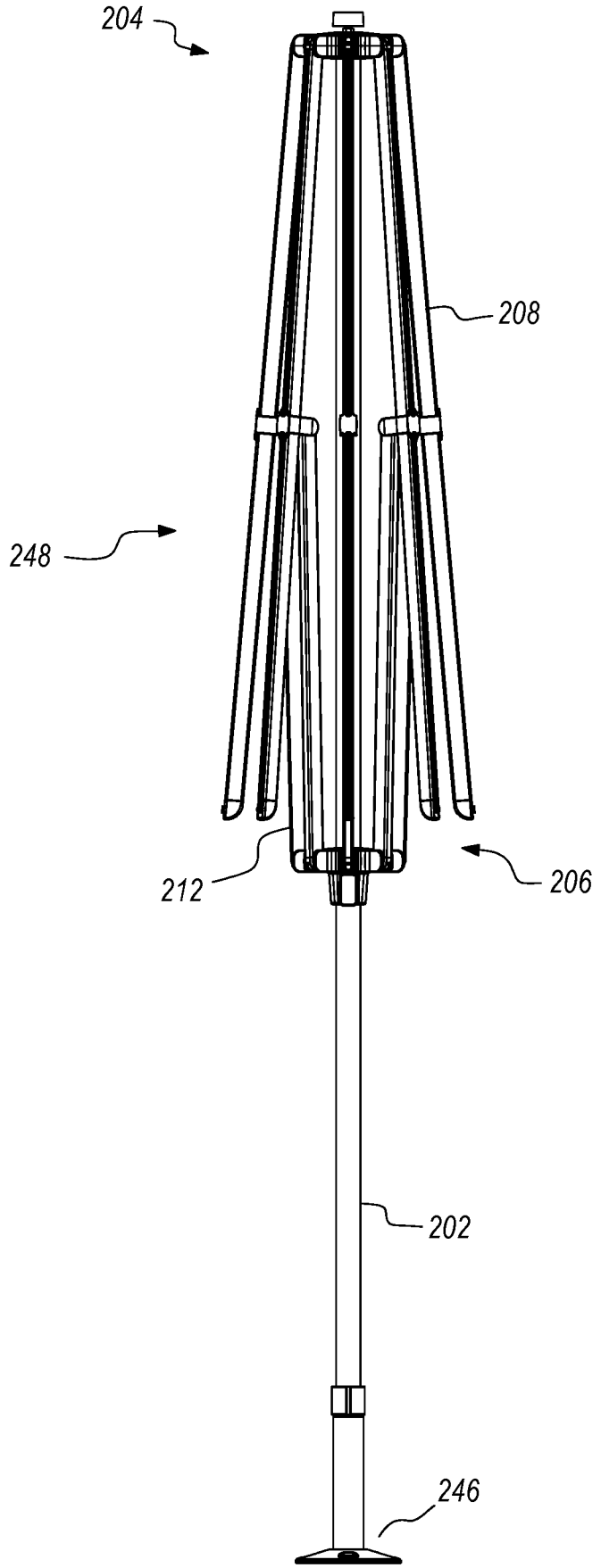
FIG. 8 is a side view of the umbrella seen in FIG. 7, with optional base, but without the canopy, showing the umbrella in the closed position.
Figure 9:
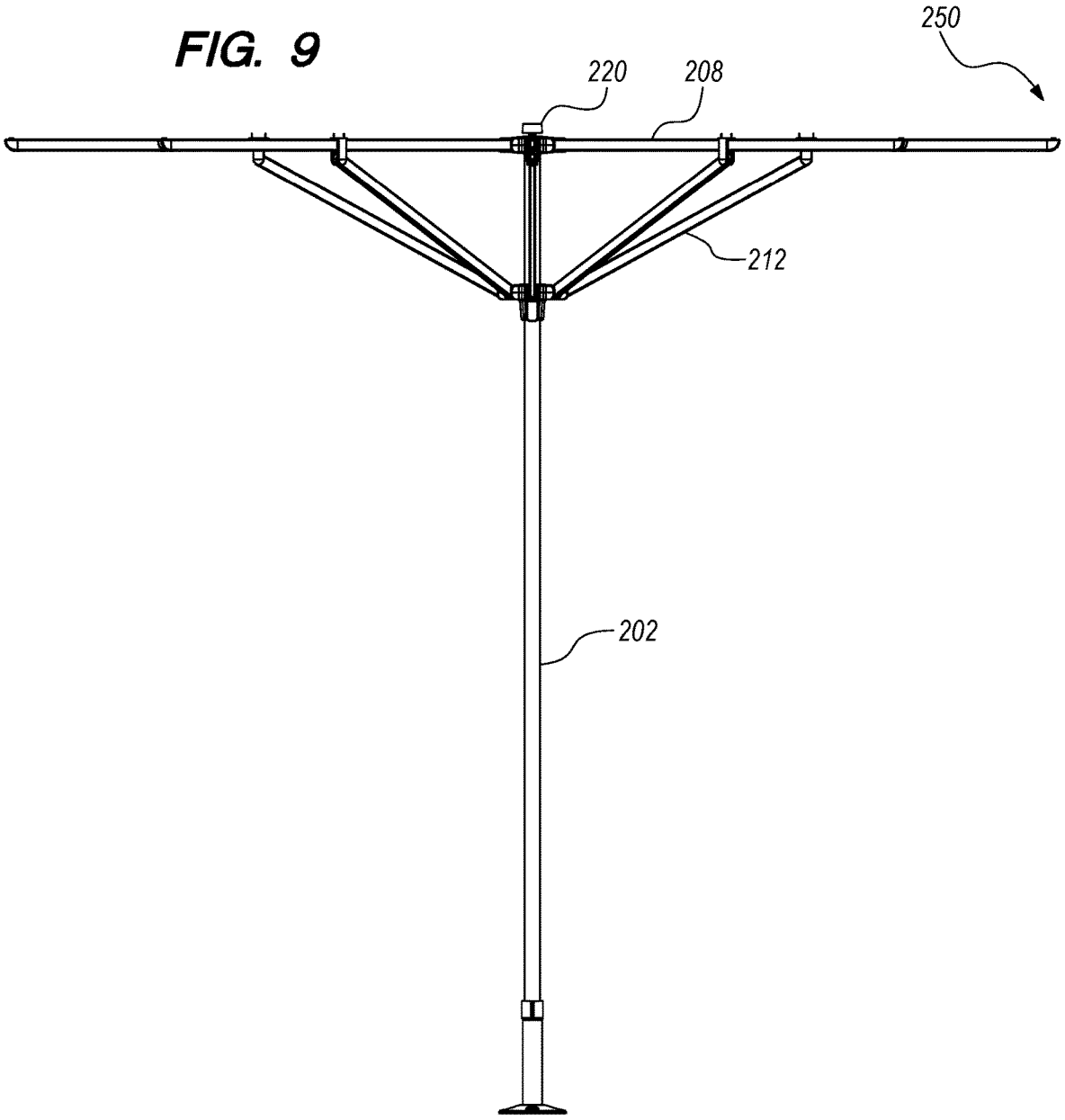
FIG. 9 is a side view of the umbrella seen in FIG. 8, showing the umbrella in the open position.
Figure 10A:
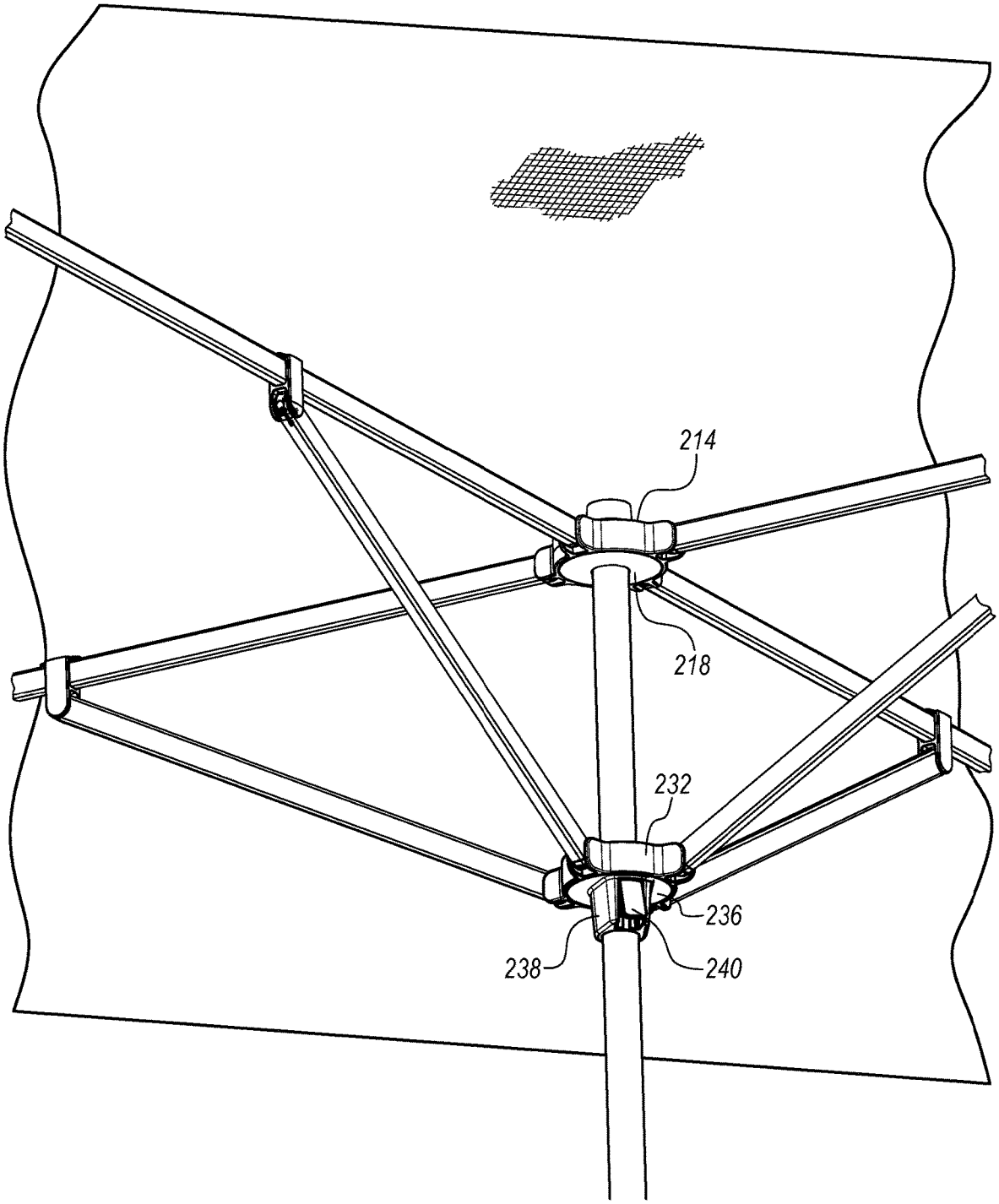
FIG. 10A is a perspective view of the top hub and spoke arrangement, and opposing bottom hub and strut arrangement of the umbrella seen in FIG. 7.
Figure 10B:
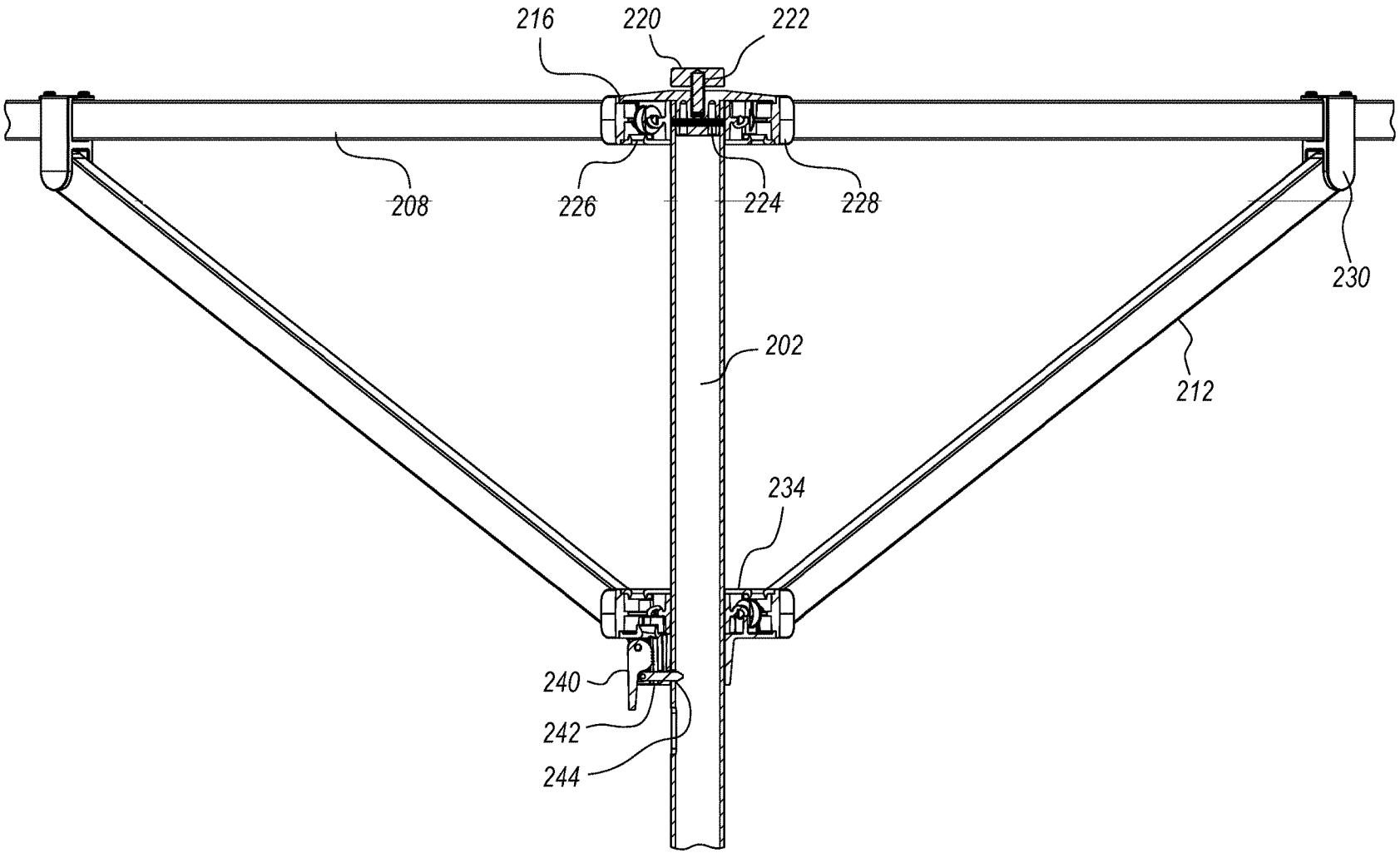
FIG. 10B is a cross-sectional view of the top hub and spoke arrangement, as well as the opposing bottom hub and strut arrangement, of the umbrella seen in FIG. 7.

The details of the bottom housing 106 may be best seen with reference to FIG. 6. There, bottom housing 106 is illustrated with a bottom hub 142 preferably made of thermoplastic. Bottom hub 142 has a top cap 144 and an opposing bottom cap 146. The top cap 144 has holes 148 for receiving the rope 180 used to raise and lower the canopy 110. The top cap 144 is preferably made of thermoplastic and is adapted to snap into the bottom hub 142.

The bottom hub 142 has a cavity 150 and roller channels 152. Each roller channel 152 receives a roller 154 with its roller axle 156. The roller 154 is preferably made of thermoplastic, whereas the roller axle 156 is preferably made of stainless steel. Each roller 154 and axle 156 assembly snaps into its respective roller channel 152 as seen in FIG. 6.

In particular, a third set of rollers 154*b*, 154*c* are retained within the bottom housing 106 and aligned together along a side of the bottom housing 106. The axis of the third set (154*b*, 154*c*) of rollers is substantially orthogonal to the axes of the first (130*a*, 130*c*) and second (130*b*, 130*d*) sets of rollers. The umbrella 100 may further comprise a roller 154*a* retained within the bottom housing 106 and disposed along a side of the bottom housing 106 opposite the third (154*b*, 154*c*) set of rollers.

Hardware (not shown), such as screws, are fitted within holes 158 for coupling the bottom cap 146 to the bottom hub 142.

As seen in FIG. 6, the bottom hub 142 also has a plurality of strut channels 182 extending away from the bottom hub 142. Each strut channel 182 is adapted to receive two-piece strut ends 184, which screw into guides in the extruded struts 112.

The bottom cap 146 also has threaded receptacles 160 for receiving the hardware used to attach the bottom cap 146 to the bottom hub 142. An optional rope slot may be disposed about the bottom cap 146, as well as an anchor point for retaining the rope 180 between the bottom hub 142 and bottom cap 146. The bottom cap 146 further has a rope channel 164 and a lever lock receptacle 166 extending downward from the bottom cap 146. The lever lock receptacle is adapted to engage a lever lock 168. The rope channel 164 is large enough to receive one end of the rope 180 before it is engaged by the lever lock 168. To keep things streamlined and elegant, the rest of the rope 180 may be stored within rope storage slot 170.

In operation, when the user desires to raise the canopy 110 from the closed position 176 to the open one 178, the user will grab the rope 180 and pull downward on it. Doing so will engage the block and tackle assembly comprised of the rollers 130 in the top housing 104, the rollers 154 in the bottom housing 106, and the rope 180 fitted around each of the rollers 130, 154. Such an arrangement advantageously provides increased leverage for raising the canopy 110.

In particular, the rope 180 runs through the rope channel 164, through hole 180, through hole 148*a*, up through hole 136*a*, around roller 130*a*, around roller 130*c*, down through hole 136*c*, through hole 148*c*, around roller 154*b*, around roller 154*c*, through hole 148*d*, through hole 136*d*, up to hole 136*d*, around roller 130*d*, around roller 130*b*, down through hole 136*b*, through hole 148*b*, around roller 154*a*, and then anchored. Once the canopy 110 has been fully raised, the user will then close lever lock 168 to keep the canopy 110 opened, and then store any excess rope 180 tidily in the rope storage slot 170.

Instead of the block and tackle pulley arrangement discussed above, the invention may employ a manual lift arrangement. FIGS. 7-10B illustrate just such an embodiment. Here, umbrella 200 comprises a support post 202 having a top housing 204 and an opposing bottom housing 206. A plurality of spokes 208 are pivotally disposed about the top housing 204. Each spoke 208 has a first end 228 and an opposing bottom end. A canopy 210 is disposed about the spokes 208. An optional base 246 may be disposed about one end of the support post 202 opposite the end where the canopy 210 is disposed.

The top housing 204 has a top hub 214 with a top plate 216 and an opposing bottom cover 218. A finial 220 is coupled to the top plate 216 via a rod 222. The finial 220 helps retain the canopy 210 about the spokes 208. A drive pin 224 retains the top plate 216 to the top hub 214. The top hub 214 has a plurality of spoke channels 226 extending radially outward from the hub 214. Each spoke channel 226 is adapted to receive each spoke end 228 of each spoke 208. Each spoke is coupled to each strut via a spoke/strut connector 230, as seen for example in FIG. 10B.

The bottom housing 206 has a bottom hub 232 with a top cap 234 and an opposing bottom cap 236. The bottom cap 236 has a lever lock receptacle extending therefrom for receiving a lever lock 240. The lever lock includes a pin 240 for inserting into a hole 244 in the post 202. One end of each strut 212 is pivotally connected to the bottom housing 206; the other end of each strut 212 is pivotally connected to a respective spoke 208 via a respective connector 230.

The spokes 208, struts 212, and post 202 are preferably extruded aluminum and may be in satin anodized or powder coated finishes. The top and bottom housings 204, 206 are preferably made of thermoplastic.

To operate the umbrella 200 from its closed position 248 to its open position 250, the user will push bottom housing 206 up toward the top housing 204. Doing so will cause the plurality of struts 212 to push upward against the plurality of spokes 208, moving the spokes 208 from a generally parallel relationship to the post 202 to a generally orthogonal relationship with the post 202, until the canopy 210 is fully opened, as seen for example in FIG. 10B. Once fully opened, the user will push the lever lock 240 with its pin 242 into hole 244 in post 202 to maintain the umbrella 200 in its open position 250.

It should now be apparent the disclosed umbrellas 100, 200 have a simplified structure to create a clean, elegant profile.

While certain embodiments have been described, the embodiments have been presented by way of example only and are not intended to limit the scope of the inventions. Indeed, the novel umbrella embodiments described herein may be embodied in a variety of other forms. Furthermore, various omissions, substitutions, and changes in the form of the disclosed elements may be made without departing from the spirit of the inventions. The accompanying claims and their equivalents are intended to cover such forms or modifications as would fall within the scope and spirit of the inventions.

The invention claimed is:

1. An umbrella comprising:

a support post;

a top housing supported by the post;

a bottom housing supported by the post;

a plurality of spokes pivotally disposed about the top housing;

a plurality of struts pivotally disposed about the bottom housing, each strut pivotally connected to a respective spoke;

a canopy disposed about the plurality of spokes;

a first set of rollers retained with the top housing and aligned together along one side of the top housing;

a second set of rollers retained with the top housing and aligned together along a side of the top housing opposite the first set of rollers, wherein the axes of the first and second sets of rollers are substantially parallel to one another;

a third set of rollers retained within the bottom housing and aligned together along a side of the bottom housing, wherein the axis of the third set of rollers is substantially orthogonal to the axes of the first and second sets of rollers;

a rope for raising and lowering the canopy, wherein the rope runs along the first set of rollers, along the third set of rollers, and then along the second set of rollers; and a roller retained within the bottom housing and disposed along a side of the bottom housing opposite the third set of rollers, wherein the rope runs along the first set of rollers, along the third set of rollers, along the second set of rollers, and then to the roller within the bottom housing.

2. The umbrella of claim 1, further comprising a hole within the bottom housing, wherein the hole is adapted to receive the rope, wherein the rope runs through the hole, along the first set of rollers, along the third set of rollers, along the second set of rollers, and then to the roller within the bottom housing.

3. The umbrella of claim 2, further comprising a lever lock disposed about the bottom housing, wherein the lever lock is adapted to retain the rope, wherein when the umbrella is in an open position, the rope is retained by the lever lock, runs through the hole within the bottom housing, along the first set of rollers, along the third set of rollers, along the second set of rollers, and then to the roller within the bottom housing.

4. The umbrella of claim 1, further comprising a rope storage slot within the support post for retaining any excess rope.

5. The umbrella of claim 3, further comprising a rope storage slot within the support post beneath the lever lock, wherein the rope storage slot is adapted to receive the rope, wherein when the umbrella is in an open position, a portion of the rope is received within the rope storage slot, with the remainder of the rope being retained by the lever lock after the rope runs through the hole within the bottom housing, along the first set of rollers, along the third set of rollers, along the second set of rollers, and then to the roller within the bottom housing.

6. An umbrella comprising:

a support post;

a top housing supported by the post, wherein the top housing has a top hub, a top plate disposed about the top hub, and a bottom cover disposed about the top hub opposite the top plate, wherein the top hub has a first set of roller channels cut within the top hub, wherein the top hub has a second set of rollers channels cut within the top hub substantially opposite the first set of roller channels;

a bottom housing support by the post opposite the top housing, wherein the bottom housing has a bottom hub, a top cap disposed about the bottom hub, and a bottom cap disposed about the bottom hub opposite the top cap, wherein the bottom hub has a third set of roller channels cut within the bottom hub;

a first set of rollers retained within the first set of roller channels;

a second set of rollers retained within the second set of roller channels;

a third set of rollers retained within the third set of roller channels;

one or more spokes pivotally disposed about the top housing;

one or more struts pivotally disposed about the bottom housing, each strut pivotally connected to a respective spoke;

a canopy disposed about the one or more spokes; and a rope for raising and lowering the canopy, wherein the rope runs along the first set of rollers, along the third set of rollers, and then along the second set of rollers.

7. The umbrella of claim 6, wherein the third set of rollers is disposed substantially orthogonal to the first set of rollers and the second set of rollers.

8. The umbrella of claim 7, further comprising a lever lock disposed about the bottom cap, wherein the lever lock is adapted to retain the rope when the umbrella is in an open position.

9. The umbrella of claim 8, further comprising a rope storage slot within the post and disposed about the lever lock.

10. An umbrella comprising:

a support post;

a top housing supported by the post;

a bottom housing supported by the post;

a plurality of spokes pivotally disposed about the top housing;

a plurality of struts pivotally disposed about the bottom housing, each strut pivotally connected to a respective spoke;

a canopy disposed about the plurality of spokes;

a first set of rollers retained with the top housing and aligned together along one side of the top housing;

a second set of rollers retained with the top housing and aligned together along a side of the top housing opposite the first set of rollers, wherein the axes of the first and second sets of rollers are substantially parallel to one another;

a third set of rollers retained within the bottom housing and aligned together along a side of the bottom housing, wherein the axis of the third set of rollers is substantially orthogonal to the axes of the first and second sets of rollers;

a rope for raising and lowering the canopy, wherein the rope runs along the first set of rollers, along the third set of rollers, and then along the second set of rollers; and a rope storage slot within the support post for retaining any excess rope.

11. The umbrella of claim 10, further comprising a roller retained within the bottom housing and disposed along a side of the bottom housing opposite the third set of rollers, wherein the rope runs along the first set of rollers, along the third set of rollers, along the second set of rollers, and then to the roller within the bottom housing.

12. The umbrella of claim 11, further comprising a hole within the bottom housing, wherein the hole is adapted to receive the rope, wherein the rope runs through the hole, along the first set of rollers, along the third set of rollers, along the second set of rollers, and then to the roller within the bottom housing.

13. The umbrella of claim 12, further comprising a lever lock disposed about the bottom housing, wherein the lever lock is adapted to retain the rope, wherein when the umbrella is in an open position, the rope is retained by the lever lock, runs through the hole within the bottom housing, along the first set of rollers, along the third set of rollers, along the second set of rollers, and then to the roller within the bottom housing.

* * * * *